US009422755B2

(12) United States Patent
Van Parys

(10) Patent No.: US 9,422,755 B2
(45) Date of Patent: Aug. 23, 2016

(54) BUILT-IN LOCK WITH HANDLE FOR A WINDOW

(71) Applicant: Remi Emiel Van Parys, Waregem (BE)

(72) Inventor: Remi Emiel Van Parys, Waregem (BE)

( * ) Notice: Subject to any disclaimer, the term of this patent is extended or adjusted under 35 U.S.C. 154(b) by 6 days.

(21) Appl. No.: 14/593,518

(22) Filed: Jan. 9, 2015

(65) Prior Publication Data

US 2015/0197967 A1 Jul. 16, 2015

(30) Foreign Application Priority Data

Jan. 10, 2014 (BE) ..... 2014/0019

(51) Int. Cl.

| | |
|---|---|
| ***E05C 1/10*** | (2006.01) |
| ***E05B 15/00*** | (2006.01) |
| ***E05B 3/08*** | (2006.01) |
| ***E05B 1/00*** | (2006.01) |
| ***E05B 3/00*** | (2006.01) |
| *E05C 9/00* | (2006.01) |

(52) U.S. Cl.

CPC ..... *E05C 1/10* (2013.01); *E05B 1/003* (2013.01); *E05B 3/003* (2013.01); *E05B 3/08* (2013.01); *E05B 15/0013* (2013.01); *E05B 15/0033* (2013.01); *E05C 9/00* (2013.01); *Y10T 292/57* (2015.04)

(58) Field of Classification Search

CPC ..... E05B 3/003; E05B 3/04; E05B 3/08; E05B 15/0033; E05C 1/10; E05C 9/00; E05F 11/10; Y10T 292/57

See application file for complete search history.

(56) References Cited

U.S. PATENT DOCUMENTS

| | | | | |
|---|---|---|---|---|
| 3,866,355 A * | 2/1975 | Jacob | E05C 9/00 | 49/192 |
| 5,882,053 A * | 3/1999 | Bekins | E05B 1/003 | 292/336.3 |
| 6,328,357 B1 * | 12/2001 | Overbey | E05B 1/003 | 292/172 |
| 7,156,432 B2 * | 1/2007 | Sledge | E05B 3/003 | 292/358 |
| 8,641,102 B2 * | 2/2014 | Wang | E05C 9/00 | 292/347 |
| 2013/0175811 A1 | 7/2013 | Hodgin | | |
| 2014/0001779 A1 * | 1/2014 | Bedoian | E05B 1/003 | 292/336.3 |

FOREIGN PATENT DOCUMENTS

| | | |
|---|---|---|
| CH | 599 435 A5 | 5/1978 |
| CH | 670 861 A5 | 7/1989 |

(Continued)

OTHER PUBLICATIONS

Written Opinion for Belgium application BE201400019 dated Aug. 26, 2014 [BE237A].

(Continued)

*Primary Examiner* — David E Allred

*Assistant Examiner* — Catherine A Kelly

(74) *Attorney, Agent, or Firm* — Sughrue Mion, PLLC

(57) ABSTRACT

Built-in lock that includes a handle with a lever and a spindle; an operating mechanism for converting the rotation of the handle into a translation of a locking slat and a base, whereby the operating mechanism is held fast by a clamping plate that is movable in the axial direction of the spindle, whereby the clamping plate is provided with a bearing for the rotation of the handle, whereby this bearing is held fast in the clamping plate in the axial direction and whereby this bearing is provided with a clip mechanism to lock the spindle in the axial direction with respect to the bearing in the mounted situation.

14 Claims, 6 Drawing Sheets

(56) References Cited

FOREIGN PATENT DOCUMENTS

| | | | | |
|---|---|---|---|---|
| DE | 195 27 450 A1 | 3/1996 | | |
| DE | EP 1321604 A1 * | 6/2003 | ..... | E05B 3/00 |

OTHER PUBLICATIONS

International-Type Search Report for Belgium application BE201400019 dated Aug. 26, 2014 [PCT/ISA/201].

* cited by examiner

BUILT-IN LOCK WITH HANDLE FOR A WINDOW

This application claims priority from on Belgian Patent Application No. 2014/0019 filed Jan. 10, 2014, the contents of all of which are incorporated herein by reference in their entirety.

BACKGROUND OF THE INVENTION

1. Field of the Invention

The present invention relates to a built-in lock for locking a window consisting of a leaf that is turnably affixed in a fixed frame.

2. Background

It is known that to lock the leaf in the frame of a window, the leaf is provided with a fitting groove along its outer periphery in which at least one locking slat is movably affixed, whereby this locking slat is provided with one or more studs and which can move with the locking slat between a locked position in which the studs on the locking slat are held in corresponding lock holes of the fixed frame, and an unlocked position in which the studs are withdrawn from these lock holes.

The built-in lock comprises a handle in a known way with a lever and a spindle that fits in an operating mechanism that is fastened at the location of the aforementioned fitting groove and which is intended for converting the rotation of the handle into a translation for moving the at least one locking slat between the aforementioned locked and unlocked positions.

Conventionally the handle is fastened turnably in a 'base' with which the handle can be fastened on the leaf by means of screws or similar that insert through screw holes that are provided in the base to this end.

Such a base must protrude outside the base of the handle to provide access to the aforementioned screw holes of the base.

Such a base is then also relatively large and interferes with the aesthetic appearance of the window, also due to the fact that the screws are prominently visible in the screw holes.

Moreover, with such a built-in lock the handle must always remain mounted on the window, which means that such windows take up extra space and consequently fewer windows can be transported per load.

In addition, such a mounted handle forms a potential risk of damage to itself and to other windows during transport or handling of the windows.

'Baseless' handles are now also known, whereby the base can be mounted on the window separate from the handle by means of screws or similar.

After mounting the operating mechanism in the fitting groove and the base on the front of the leaf, the handle is mounted, whereby the spindle of the handle is pushed through a passage in the base into the operating mechanism until the base of the lever of the handle comes up against the base.

Because the base can be mounted on the leaf as a separate component, the screw holes in the base do not necessarily have to be accessible when the handle is mounted, such that the base does not necessarily have to protrude outside the handle and thus can be made less conspicuous and can be somewhat concealed under the base of the handle.

Such built-in locks with a baseless handle are already known whereby the spindle of the handle can be snapped into the operating mechanism by means of a spring-loaded pin that is mounted in the spindle of the handle and which snaps into the operating mechanism when the base of the lever comes up against the base. An example of this is described in DE 195.27.450.

As a result of the spring-loaded pin the handle cannot be removed unintentionally. If necessary the lever can be removed by pushing the pin back in a cutaway in the operating mechanism with a tool.

This provides the advantage that the handle does not necessarily have to be mounted during transport and as a result can prevent the disadvantages attached thereto.

The place where the spring-loaded pin must be provided on the spindle of the handle depends on the distance at which the operating mechanism is mounted from the front of the leaf, or thus from the place where the fitting groove is located with respect to the front of the leaf, as the operating mechanism is mounted on the leaf at the location of such a fitting groove.

As there are many types of profiles from which a leaf of a window can be built, each with a different position of the fitting groove, a different handle must be used for each type of profile with a suitable location of the spring-loaded pin on the spindle.

Another known solution consists of providing the same handle for a number of types of profiles with a fixed position of the spring-loaded pin, but by providing a base with an upright high collar in order to conceal the clearance between the base of the lever and the front of the leaf. In this case, use is made of different clamping plates to fill up the space between the built-in lock and the front wall of the leaf against which the base is affixed.

A disadvantage of the known built-in locks with a baseless handle is that a number of types of handles have to be used for a number of types of window profiles.

A disadvantage attached to this is that mistakes are not ruled out with an incorrect size of handle or base belonging to a certain type of window.

SUMMARY OF THE INVENTION

The purpose of the present invention is to provide a solution to one or more of the aforementioned and/or other disadvantages.

To this end the invention concerns a built-in lock that comprises a handle with a lever and spindle; an operating mechanism for converting the rotation of the handle into a translation for moving the at least one locking slat; and a base that is separate from the lever and which is provided with a passage for the spindle of the handle, with the characteristic that the operating mechanism comprises a clamping plate for holding the operating mechanism on the window, whereby this clamping plate is movable in the axial direction of the spindle, and there are means to draw the clamping plate in the axial direction towards the base to fasten the clamping plate on the window, whereby the clamping plate is provided with a bearing for the rotation of the handle, whereby this bearing is held fast in the clamping plate in the axial direction and whereby this bearing is provided with a clip mechanism to lock the spindle in the axial direction with respect to the bearing in the mounted situation.

When fitting the built-in lock the operating mechanism is affixed on the leaf and is held by drawing the clamping plate against an upright front wall of the leaf profile, which forms the front of the leaf, and fastening the clamping plate by means of the base that is mounted against the front by means of screws that are screwed tight through the upright lip in the clamping plate.

Then the handle is mounted by inserting the spindle through the base into the bearing in the clamping plate, such that the spindle snaps into the bearing and consequently cannot be removed unintentionally.

Because the bearing is immobilised axially in the clamping plate and the clamping plate is drawn against the upright front wall, the clip mechanism of the bearing is always at a fixed distance from the base on the front of the upright front wall concerned, irrespective of the type of window profile on which the operating mechanism is affixed, albeit save for the possible thickness differences of the upright front wall.

This provides the advantage that the spindle of the handle is always snapped into the bearing at the same place, such that the same handle can be used for a number of types of window profiles, and this irrespective of the location of the operating mechanism and thus the fitting groove with respect to the front wall.

Furthermore, the built-in lock according to the invention provides all the aforementioned advantages of a built-in lock with baseless handle.

According to a particular characteristic of the invention the ring is composed of a dish and slider with a passage for the spindle of the handle, whereby this slider is affixed movably in a direction transverse to the axial direction of the spindle and can engage with a notch in the spindle of the handle to lock the handle in the axial direction.

In order to be able to accommodate the different thickness of the front wall, a chamber can be provided in the base of the lever of the handle in which a pressure piece is movably affixed in the axial direction between a withdrawn position, in which the pressure piece is entirely withdrawn from the chamber, and a pushed-out position in which the pressure piece protrudes partly out of the chamber, and whereby a spring is provided in the chamber that pushes the pressure piece towards the aforementioned pushed-out position.

In this way all possible play is accommodated between the lever and the base on the front of the leaf.

The invention also relates to a window with a built-in lock according to the invention as described above.

BRIEF DESCRIPTION OF THE DRAWINGS

With the intention of better showing the characteristics of the invention, a preferred embodiment of a built-in lock according to the invention and a window equipped therewith is described hereinafter by way of an example, without any limiting nature, with reference to the accompanying drawings, wherein.

DETAILED DESCRIPTION OF THE INVENTION

Figure 1:
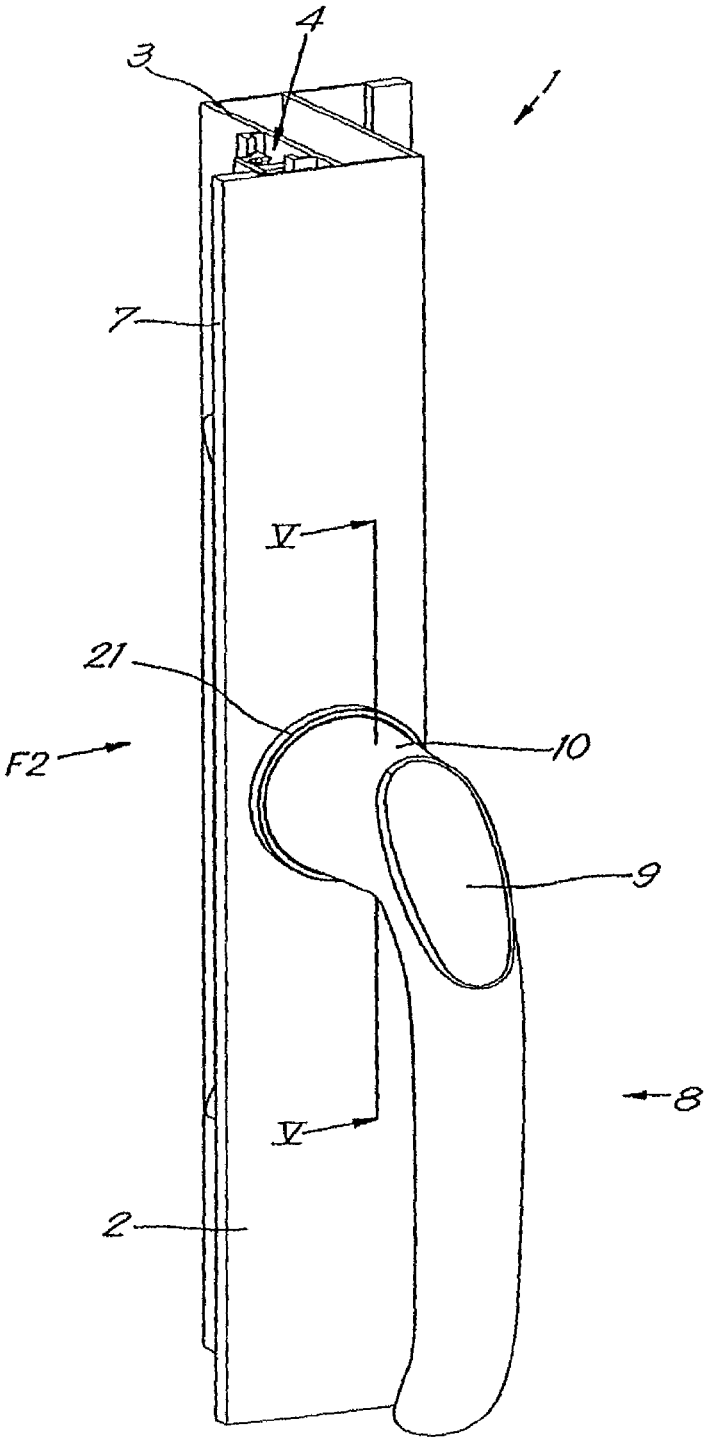
FIG. 1 schematically shows a perspective view of a part of a profile of a leaf of a window that is equipped with a built-in lock according to the invention.
Figure 2:
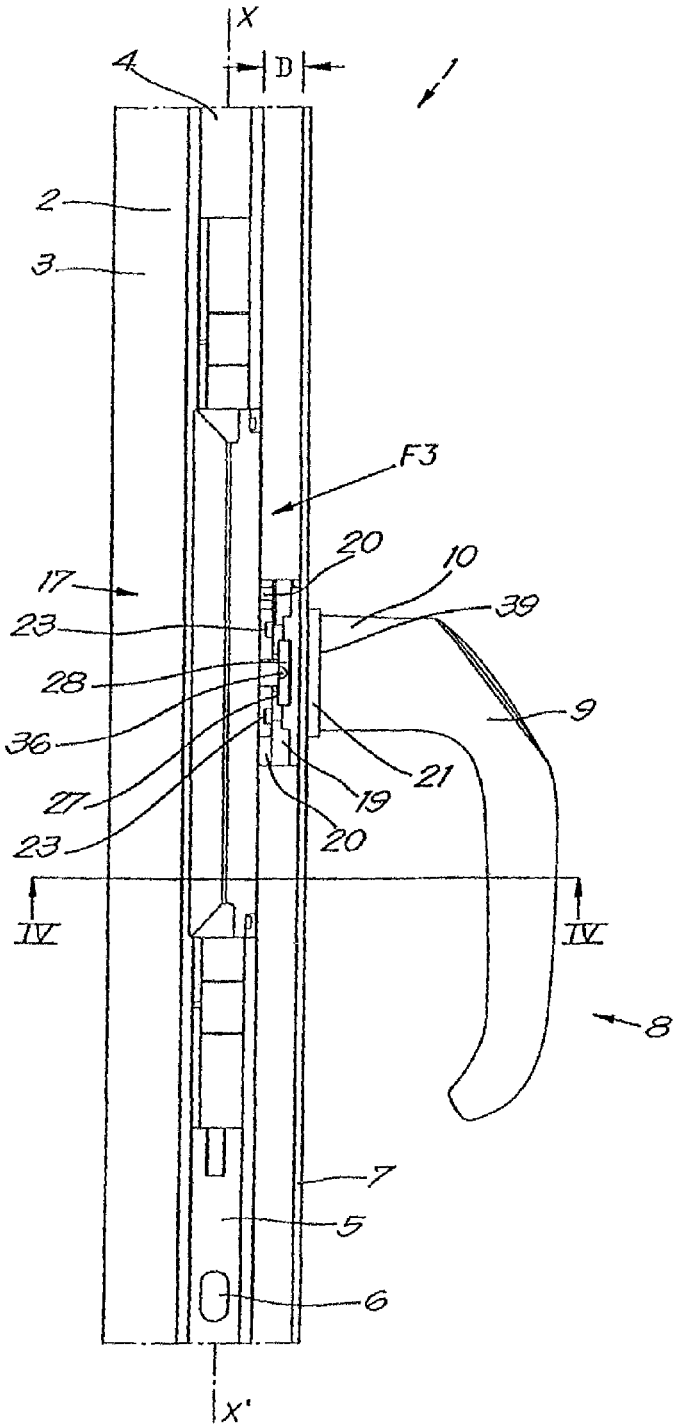
FIG. 2 shows a side view in the direction of the arrow F2 in FIG. 1.
Figure 3:
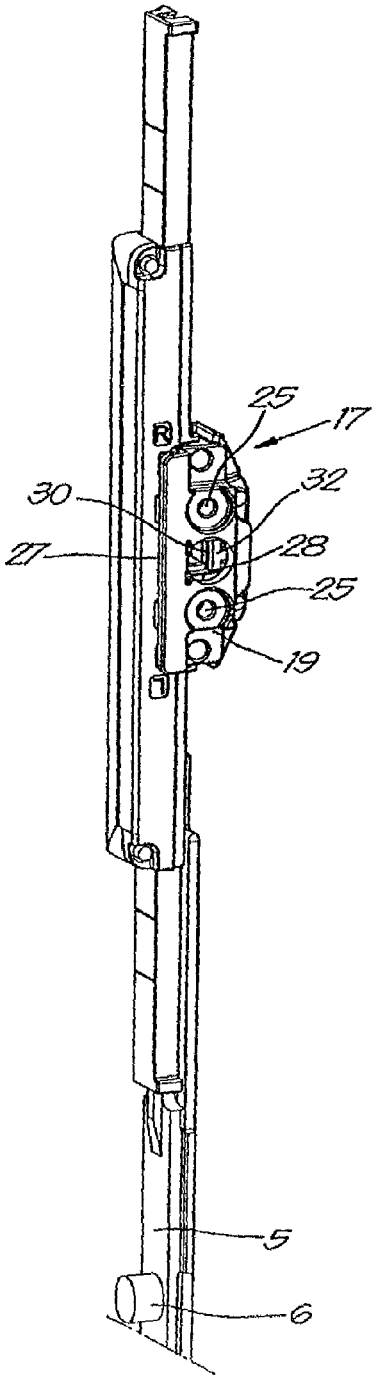
FIG. 3 shows a perspective view of the section of the built-in lock indicated by F3 in FIG. 2.

The section of a leaf 1 of a window shown in FIGS. 1 and 2 comprises a section of a leaf profile 2 from which the leaf 1 is composed.

As is known, on an outer wall 3 along the outer periphery of the leaf 2 this leaf profile is provided with a 'fitting groove' 4 in which a locking slat 5 with a stud 6 thereon is affixed movably in the longitudinal direction X-X' of the leaf profile 2.

The leaf profile 2 is provided with a front wall 7 in the form of an upright lip that is perpendicular to the aforementioned outer wall 3 with fitting groove 4.

Figure 5:
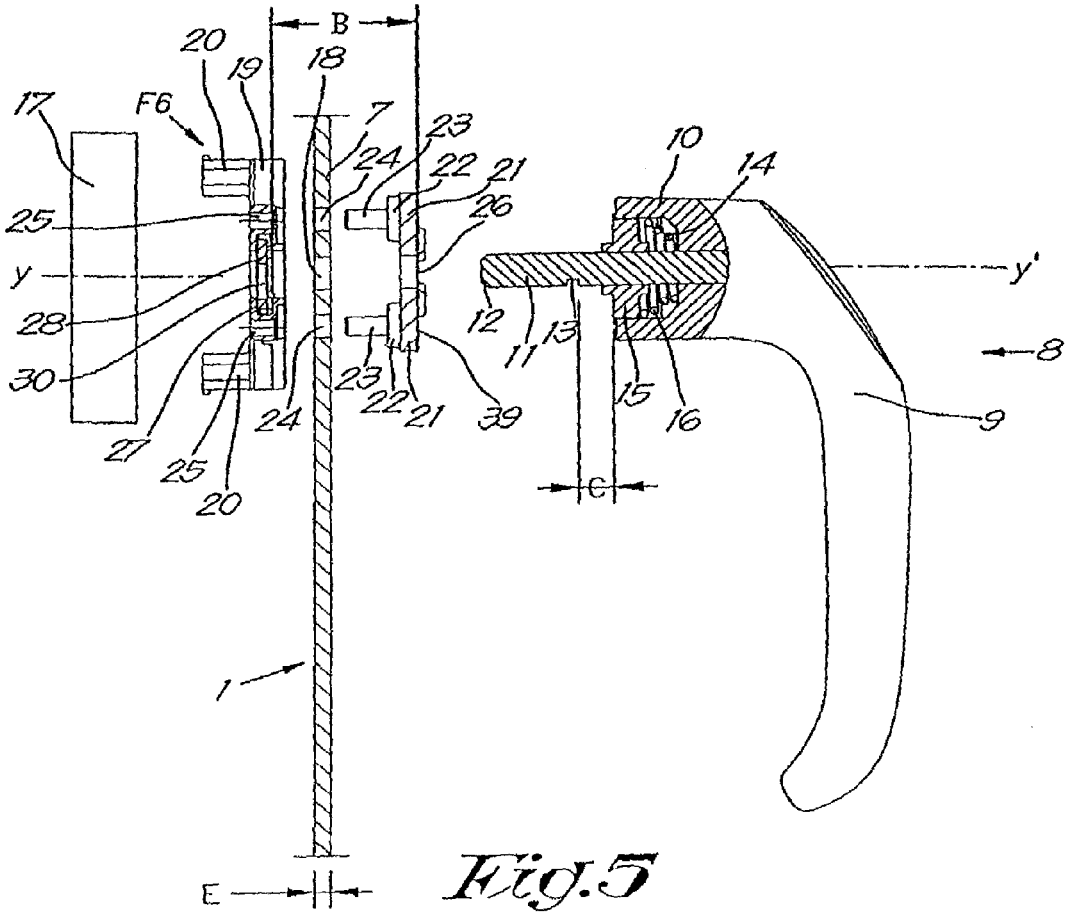
FIG. 5 shows a cross-section according to line V-V of FIG. 1, but in an exploded view.

A handle 8 is mounted on this front wall 7, which, as can be seen in FIG. 5, consists of a lever 9 with a base 10 in which a spindle 11 with a square cross-section is fastened.

The spindle 11 is provided at its free end with a bevel 12 and a notch 13 at a distance from this free end.

An open chamber 14 is provided in the base 10 of the lever 9 in which a pressure piece 15 is movably affixed around the spindle 11 in the axial direction Y-Y' of the spindle 11 between a withdrawn position in which the pressure piece is entirely withdrawn from the chamber 14 and a pushed-out position as shown in FIG. 5, in which the pressure piece 15 protrudes partly out of the chamber 14.

A spring 16 is affixed in the chamber 14 that pushes the pressure piece 15 to the aforementioned pushed-out position of FIG. 5.

At the location of the fitting groove 4 an operating mechanism 17 is affixed for converting the rotation of the handle 8 into a translation of the locking slat 5 in the fitting groove 4, to which the handle 8 is affixed with the spindle 11 through a passage 18 in the front wall 7 and is coupled to the operating mechanism 7 by the free end of the spindle 11.

The operating mechanism 17 is held at the location of the fitting groove 4 by means of a clamping plate 19 that is movable sideways with respect to the fitting groove 4 and which is provided with two arms 20 to this end that are movably guided in holes of the operating mechanism 17.

Figure 6:
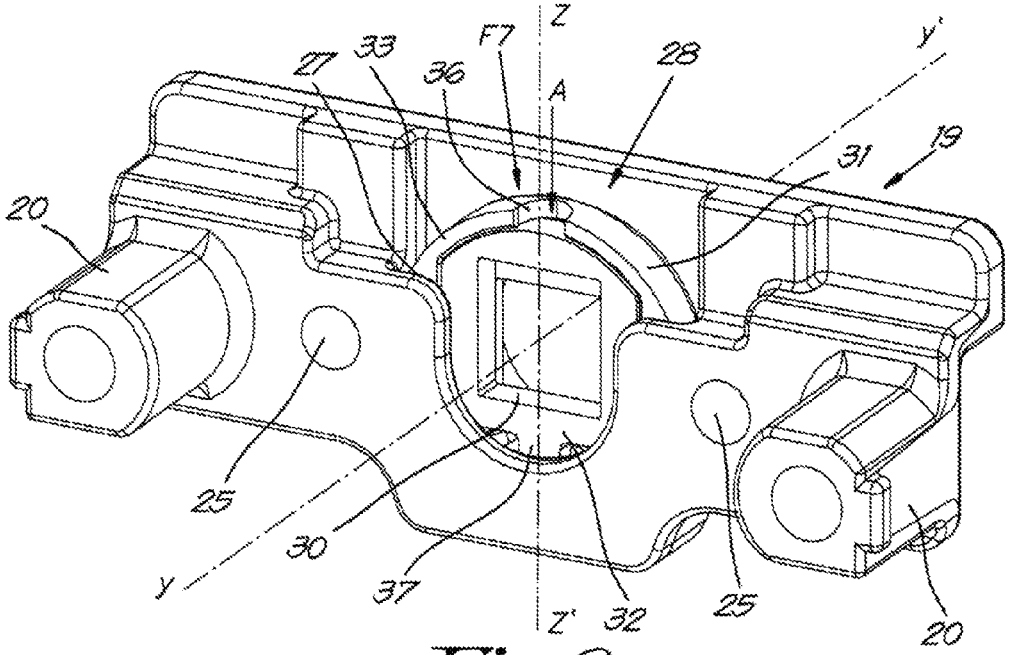
FIG. 6 shows a perspective view of the section indicated by F6 in FIG. 5 on a larger scale.

The clamping plate 19 is fastened against the front wall 7 by means of a base 21 that is mounted on the other side of the front wall 7, more specifically on the front of the leaf 1 on which the handle 8 is fastened, and which, as shown in more detail in FIG. 6, is provided with passages 22 for bolts or screws 23 that are screwed tight through holes 24 in the front wall 7 in threaded screw holes 25 in the clamping plate 19.

The base 21 is provided with a passage 27 through which the spindle 11 can be mounted in the operating mechanism 17.

Figure 7:
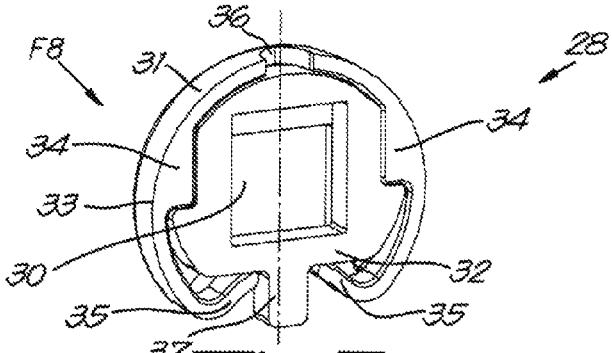
FIG. 7 shows the section indicated by F7 in FIG. 6.
Figure 8:
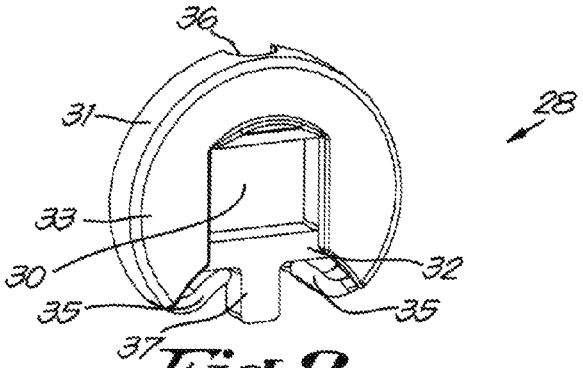
FIG. 8 shows a rear view of the section shown in FIG. 7 according to arrow F8.

A slot-shaped seat 27 is provided in the clamping plate in which a bearing 28 is affixed for the rotation of the handle 8, whereby this bearing 28 is shown as a separate component in FIGS. 7 and 8.

This bearing 28 is held in the axial direction Y-Y' in the clamping plate 19, whereby this bearing 28 is provided with clip mechanism that can engage with the notch 13 in the spindle 11 to lock the handle 8 in the axial direction Y-Y' in the mounted situation.

As shown in FIGS. 7 and 8, the bearing 28 is constructed as a ring with a square passage for the spindle 11, whereby this ring is affixed freely turnably in the seat 27 of the clamping plate 19.

The bearing 28 is composed of a dish 31 of low-friction plastic and a slider 32 of metal or similar with a passage 30 for the spindle 11 of the handle 8.

The dish 31 is constructed as a disk 33 with an essentially ring-shaped upright edge 34 that is broken locally and which is folded inwards at the location of the break to form elastic lips 35.

The slider 32 is movably affixed in the dish 31, by the profiling of the edge 34, in a direction Z-Z' transverse to the axial direction Y-Y' of the spindle 11 to be able to engage with the notch 13 of the spindle 11.

The lips 35 elastically push the slider 32 away from the broken section of the edge 34 in the direction of a cutaway 36 in the edge 34 on the opposite side of the edge 34, with the intention that the slider can be pushed away, in a radial direction according to arrow A against the action of the lips 35, from the outside by means of a screwdriver or similar via this cutaway 36 as shown in FIG. 6.

The slider 32 is provided with a radially oriented protrusion 37 which, when moving the slider 32 in the direction of arrow A, comes against the edge of the seat 27 which thereby forms an end stop for the movement of the slider 32.

Figure 4:
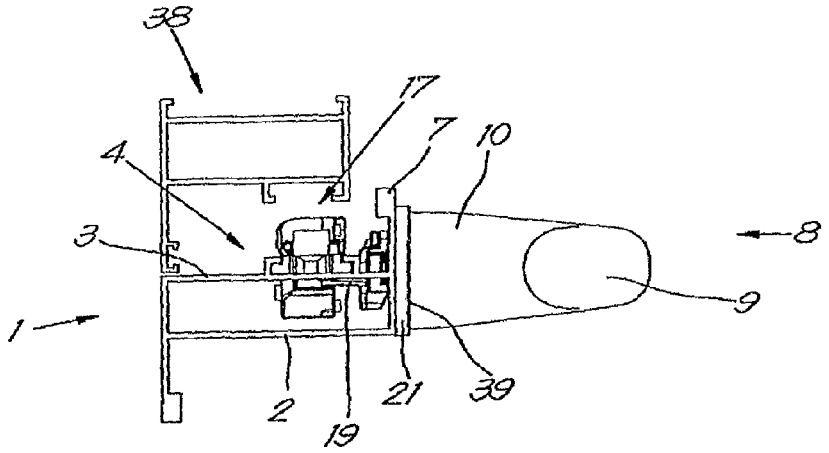
FIG. 4 shows a cross-section according to line IV-IV of FIG. 2 with the addition of a profile of the fixed frame of the window.

The operating mechanism 17 is mounted in the space between the leaf 1 and the fixed frame 38 of the window as shown in FIG. 4.

The fitting of the built-in lock according to the invention is simple and as follows.

After placing the locking slat 5 in the fitting groove 4, the operating mechanism 17 is fitted at the location of the fitting groove and is held in place by the clamping plate 19 that protrudes into the operating mechanism 17 with its arms 20, and which together with the base 21 is fastened against the front wall 7 by means of the screws 23.

The window can thus be transported without a handle 8 necessarily having to be mounted.

It is clear that in the mounted situation of the clamping plate 19 and of the base 21 the distance B between the front of the base 21, that the base 10 of the lever 9 comes against, and the front of the slider 32 in the clamping plate 19 is a fixed distance that only depends on the thickness of the front wall 7.

When the free end of the spindle 11 is pushed in the passage 30 of the bearing 28, the slider 32 is pushed by the bevel 12 of the spindle 11 in the direction of the lips 35 that have the tendency to push the slider 32 back by the spring force of the lips 35.

When the notch 13 in the spindle 11 comes to the level of the slider 32, the slider is pushed and held in the notch due to the elasticity of the lips 35, such that the spindle 11 is locked in the axial direction Y-Y' against removal.

The distance C of the notch 13 in the spindle 11 to the base 10 of the lever 9 is such that, when mounting the handle 8, the slider 32 clicks in the notch 13 when the base 10 of the lever 9 almost comes up against the base 21 with a small clearance, as in FIGS. 2 and 4.

Figure 9:
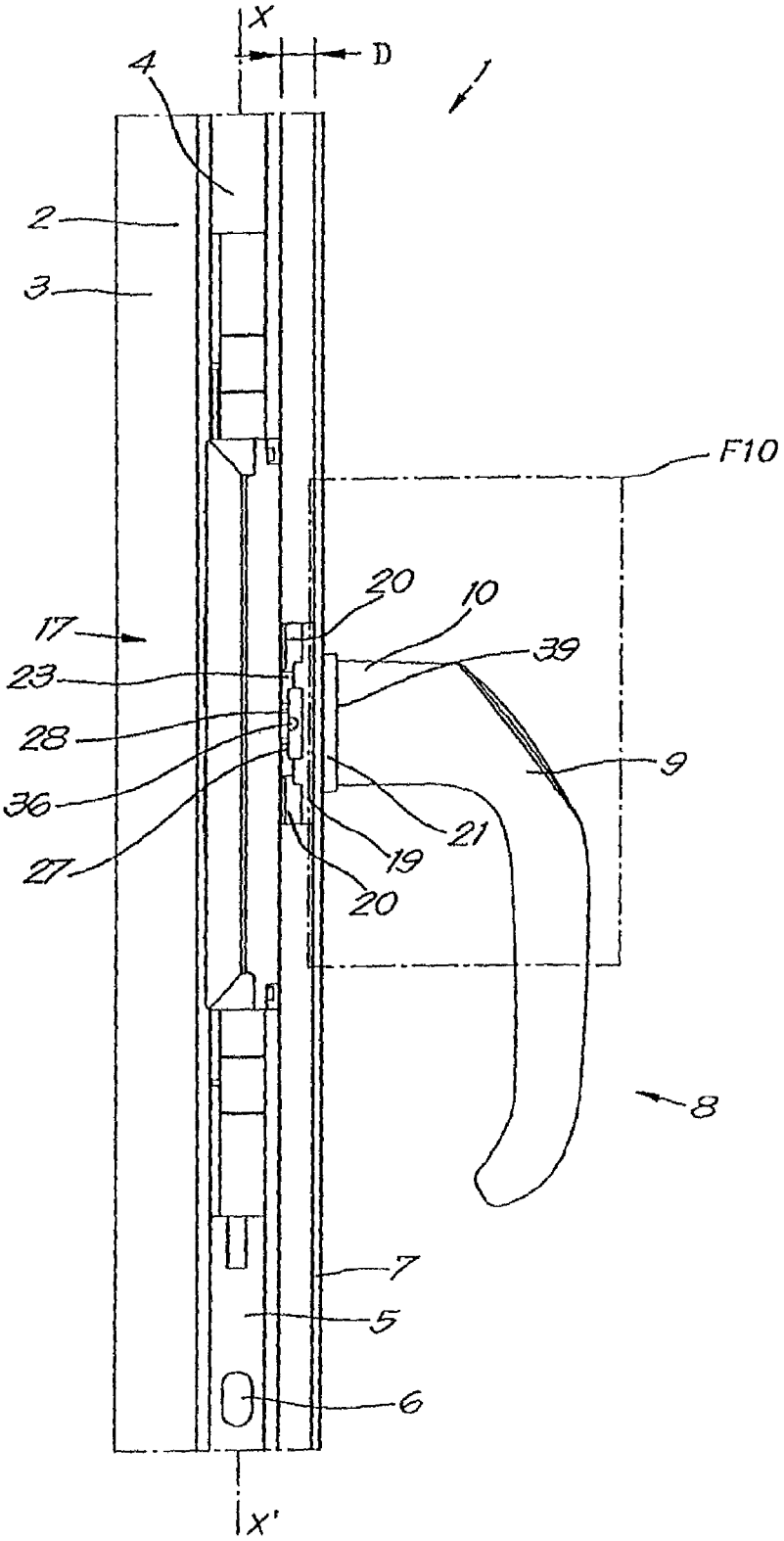
FIG. 9 shows a view such as that of FIG. 2 but for a different leaf profile.

FIG. 9 shows a situation whereby the same built-in lock is mounted on a leaf profile 2 whose distance D from the fitting groove 4 to the front wall 7 is smaller than in the case of the leaf profile 2 of FIG. 2.

This difference in distance D is accommodated by the arms 20 of the clamping plate 19 being pushed more deeply into the operating mechanism.

Insofar the thickness E of the front wall 7 is the same in both cases, the distance between the clip mechanism 29 of the bearing 28 and the handle 8 remains unchanged such that the same handle and the same base can be used in both cases.

If the thickness E of the front wall 7 is thinner then there will be a larger clearance between the front 39 of the base 21 and the base 10 of the lever 9. This clearance, if not too large, will be able to be accommodated by the pressure piece 15 that is then pushed further out of the chamber 14 by the compression spring 15 up to against the base 21.

Figure 10:
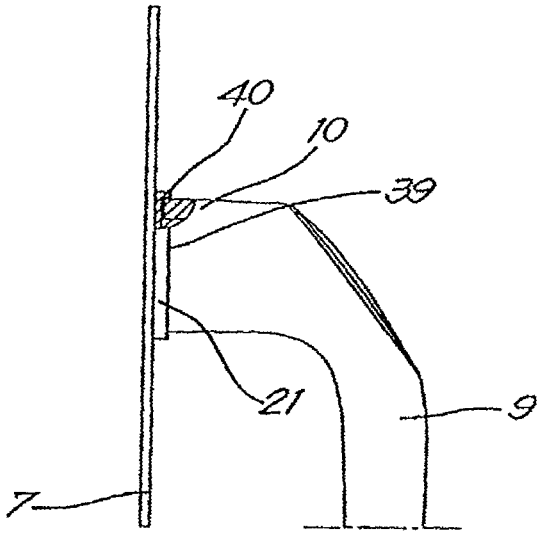
FIG. 10 shows the section indicated by the box F10 in FIG. 9 on a larger scale and with partial removal.

The small clearance that can occur due to be thickness difference E of the front wall 7 between the front 39 of the base 21 and the base 10 of the lever 9 can also be concealed by providing the base 21 with a small upright edge 40, as illustrated in FIG. 10.

It is clear that the same built-in lock with baseless handle according to the invention can be used for a number of sizes of leaf profiles 2 that can differ from one another in the distance D between the fitting groove 4 and the front wall 7, and to a certain extent in the thickness E of the front wall.

It is also clear that the spindle 11 of the handle only has to have one notch 13 at a fixed distance from the lever 9, although a number of notches 13 at different distances from the lever 9 are not excluded.

In order to dismantle the handle 8 it is sufficient to push the slider 32 out of the notch 13 via the cutaway 36 in the direction of arrow A by means of a screwdriver or similar. The protrusion 37 prevents the slider 32 from being able to be pushed out too far to prevent the accidental breaking off of the lips 35.

The present invention is by no means limited to the embodiments described as an example and shown in the drawings, but a built-in lock according to the invention can be realised in all kinds of forms and dimensions without departing from the scope of the invention.

The invention claimed is:

1. A built-in lock for a window with a leaf with a front wall and a fitting groove along a periphery of the leaf of the window with at least one locking slat that is slidable in said fitting groove, the built-in lock enabling operation of the at least one locking slat, whereby the built-in lock comprises:

a handle with a lever and a spindle with a rotational axial direction;

an operating mechanism for converting the rotation of the spindle around its axial direction into a translation of the at least one locking slat and a base that is separate from the handle and which is provided with a passage for the spindle of the handle, wherein the operating mechanism comprises a clamping plate for holding the operating mechanism on the leaf by means of clamping means allowing clamping of the clamping plate and the base together with inclusion of the front wall of the leaf, whereby the clamping plate is provided with a bearing for the rotation of the spindle, whereby the bearing is held fast in the clamping plate in the axial direction whereby the bearing is provided with a clip mechanism to lock the spindle in the axial direction with respect to the bearing the bearing being affixed freely rotatably in a seat of the clamping plate, whereby the bearing is comprised of a dish and a slider with a passage for the spindle of the handle and whereby this slider is movably affixed in the dish and biased in a biasing direction transverse to the axial direction of the spindle, enabling the slider to engage with a notch in the spindle of the handle in order to lock the handle in the axial direction.

2. The built-in lock according to claim 1 wherein the dish is provided with an upright essentially ring-shaped edge that is interrupted locally forming two free ends of which at least on free end is folded inwards to form at least one elastic lip biasing the slider in a direction transverse to the axial direction of the spindle.

3. The built-in lock according to claim 1, wherein the dish is made of plastic.

4. The built-in lock according to claim 1, wherein the spindle of the handle presents a bevel at its end, such that when the spindle is pushed through the passage in the slider, said slider is pushed away in the opposite direction of the biasing direction transverse to the axial direction.

5. The built-in lock according to claim 1, wherein in the mounted situation of the built-in lock, the slider is accessible from outside the built-in lock to be able to push the slider, when necessary, out of the notch to dismantle the handle.

6. The built-in lock according to claim 5 wherein to make the slider accessible from outside the lock, the ring and the clamping plate are provided with a cutaway or a passage for a screwdriver or another tool.

7. The built-in lock according to claim 1, wherein the built-in lock is provided with means to limit the travel of the slider.

8. The built-in lock according to claim 7, the means to limit the travel of the slider are formed by a radially oriented protrusion, which, upon reaching the end of travel of the slider, comes up against the seat of the ring.

9. The built-in lock according to claim 1, wherein the spindle of the handle is provided with only one notch at a fixed position with respect to the lever that corresponds to the position of the slider when the clamping plate and the base are mounted against the leaf with the front wall of the leaf being clamped between said clamping plate and the base, and the handle is mounted with its spindle passing through the base and through the clamping plate and with the lever of the handle against the base.

10. The built-in lock according to claim 1, wherein the dish is made of a material with a low coefficient of friction to facilitate the turning of the ring in the seat.

11. The built-in lock according to claim 1, wherein the lever of the handle is provided with a chamber, the spindle of the handle passing through said chamber and being fastened with one end in said lever, said chamber being provided, with a pressure piece that is movable in the axial direction of the spindle between a withdrawn position in which the pressure piece is completely withdrawn from the chamber, and a pushed-out position in which the pressure piece partly protrudes out of the chamber.

12. The built-in lock according to claim 11, wherein a spring is provided in the chamber that pushes the pressure piece towards the aforementioned pushed-out position.

13. The built-in lock according to claim 1 mounted in a window with a leaf, whereby the leaf comprises a frame that is comprised of leaf profiles, each profile being provided with a fitting groove stretching along the peripheral edge of the leaf with at least one locking slat that can slide in such a fitting groove and an upright front wall that is provided with a passage for the spindle of the handle of the built-in lock, whereby the operating mechanism is coupled to the at least one locking slat and is mounted opposite the passage in the front wall and is held there by means of the clamping plate that is clamped together with the base with inclusion of the front wall between the clamping plate and the base.

14. The built-in lock mounted in a window according to claim 13, wherein during transport of the window with the mounted built-in lock, said built-in lock is not yet provided with a mounted handle, which is only mounted later when the window is fitted in a home or similar by introducing the spindle of the handle through the passage in the front wall of the leaf and through the passage in the slider of the bearing with the clip mechanism to lock the spindle in its axial direction in said bearing.

* * * * *